US005385078A

United States Patent [19]

Carey et al.

[11] Patent Number: 5,385,078

[45] Date of Patent: Jan. 31, 1995

[54] CONDUCTING PHASE CHANGE MATERIAL ARMATURE FOR AN ELECTROMAGNETIC LAUNCHER SYSTEM

[75] Inventors: Van P. Carey, Albany; Minh D. Lee, San Jose, both of Calif.

[73] Assignee: Westinghouse Electric Corporation, Pittsburgh, Pa.

[21] Appl. No.: 451,397

[22] Filed: Dec. 15, 1989

[51] Int. Cl.[6] ..... F41B 6/00

[52] U.S. Cl. ..... 89/8; 124/3; 174/126.2

[58] Field of Search ..... 89/8; 124/3; 174/9 F, 174/126.2; 428/647

[56] References Cited

U.S. PATENT DOCUMENTS

| | | | |
|---|---|---|---|
| 1,748,927 | 2/1930 | Kremer | 174/9 F |
| 4,279,967 | 7/1981 | Sawada | 428/647 |
| 4,355,561 | 10/1982 | Kemeny et al. | 89/8 |
| 4,369,691 | 1/1983 | Baehr, Jr. et al. | 89/8 |
| 4,369,692 | 1/1983 | Kemeny | 89/8 |
| 4,430,921 | 2/1984 | Hughes et al. | 89/8 |
| 4,458,577 | 7/1984 | Fisher et al. | 89/8 |
| 4,467,696 | 8/1984 | McNab et al. | 89/8 |
| 4,485,720 | 12/1984 | Kemeny | 89/8 |
| 4,576,082 | 3/1986 | Scuro | 89/8 |
| 4,679,484 | 7/1987 | Kemeny | 89/8 |
| 4,715,261 | 12/1987 | Goldstein et al. | 89/8 |

OTHER PUBLICATIONS

Van P. Carey, "Thermal Control of a Solid Armature for an Electromagnetically Launched Projectile Using Liquid-Vapor or Solid-Liquid Phase Change Materials," Nov. 1986, Entire Document Report ETL-003.

Bauer et al, "Application of Electromagnetic Accelerators to Space Propulson," IEEE Transactions on Magnetics, vol. MAG-18, No. 1, Jan. 1982, pp. 170-175.

*Primary Examiner*—Stephen C. Bentley

[57] ABSTRACT

Electromagnetic launcher apparatus which includes a set of conductive rails and a projectile having an armature which comprises both primary conductive material and phase changeable conductive material. This conducting, phase change material armature comprises material which when exposed to friction induced heat changes from solid to liquid form during the launching of projectiles along the conductive rails. This conducting, phase change material armature has decreased mass particularly useful for long barrel launches.

3 Claims, 2 Drawing Sheets

CONDUCTING PHASE CHANGE MATERIAL ARMATURE FOR AN ELECTROMAGNETIC LAUNCHER SYSTEM

BACKGROUND OF THE INVENTION

This invention pertains to armatures for electromagnetic launcher systems; and more particularly to conducting phase change material armatures, comprising phase-change materials that melt from solid to liquid at temperatures lower than the melt temperatures of non-phase change material and are conductive in solid and liquid forms thereby absorbing the resistivity generated heat of the armature's slide along the conductive rails of an electromagnetic projectile launcher.

Electromagnetic projectile launchers are known which comprise; a pair of generally parallel conductor rails, a sliding conductive armature placed between the rails, providing a contact between them both and a source of high current. The passage of electrical current through the rails and the armature produces an electromagnetic force on the armature which propels it along the conductive rails. The magnetic field of the current in the rails interacts with the current in the armature to accelerate the projectile. This electromagnetic rail gun launcher has been designed with either a solid armature or a plasma armature.

A plasma armature radiates a significant amount of heat to the rails due to its high temperature, and the plasma may arc erratically, creating local hot spots on the rails. The combination of these two effects produces local melting or ablation of the rail material.

A solid armature can be designed to carry current nearly uniformly throughout its volume. Heat generated at the sliding contact surface of the armature due to friction and contact resistance losses is mild compared to plasma heating. However, heat is also generated throughout the volume of the armature due to resistance losses. To accommodate this resistance heating, solid armatures have been designed to contain enough conductive material so that this heat can be absorbed without an excessive temperature rise. However, for long launch times associated with long rail gun barrels, the mass of the armature can exceed reasonable limits imposed by system requirements on the projectile mass.

The U.S. Pat. No. 4,369,691 to Frederick J. Baehr, Jr., et al. issued Jan. 25, 1983, entitled, "Projectile Launching System with Resistive Insert in the Breech", discloses resistive inserts disposed in the breech of the projectile launcher to prevent excessive premature heating, to prevent premature movement of the projectile armature, and to prevent welding of the armature to the projectile rails during the period while the current builds up to the launching magnitude.

The U.S. Pat. No. 4,430,921 to William F. Hughes, et al. issued Feb. 14, 1984, entitled, "Armature with Graded Laminations", discloses an armature for conducting very large currents between a pair of electrically conductive parallel rails which comprises a plurality of laminations of electrically conductive material spaced in the direction of armature movement from the breech end toward the muzzle end of the rails. Wherein, by grading the conductivity of the laminations, the current density is equalized across all of the laminations.

Finally, the U.S. Pat. No. 4,467,696 to Ian R. McNab et al., issued Aug. 28, 1984, entitled "Electromagnetic Projectile Launcher with Combination Plasma/Conductor Armature" discloses a combination plasma/conductor armature structure which serves to conduct current between a pair of generally parallel conductor rails propelling a projectile along the rails.

It is the primary object of the present invention to provide an electromagnetic launcher system, and more specifically an armature which is operable to dissipate resistive heat during launch without a significant increase in armature mass.

SUMMARY OF THE INVENTION

The conducting, phase change material armature of the present invention includes; at least one layer of a conductive, phase change material which can change from a solid state to a liquid state when exposed to an increase in temperature while retaining its electrical conductivity and, at least one layer of a conductive primary armature material which is cooperatively associated with the layer(s) of conductive phase change material.

It is an embodiment of this invention to layer the conductive, phase change material in planar laminates between layers of conductive primary armature material.

It is a further embodiment of this invention to place wires of the conductive, phase change material within a solid block of the conductive primary armature material.

BRIEF DESCRIPTION OF THE DRAWINGS

For a better understanding of the invention reference may be had to the preferred embodiment exemplary of the invention, shown in the accompanying drawings, in which.

DESCRIPTION OF THE PREFERRED EMBODIMENT

Figure 1:
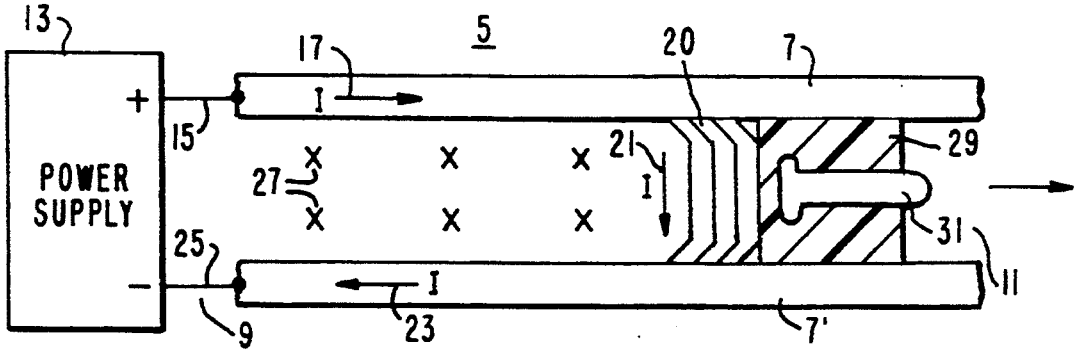
FIG. 1 is a schematic representation of an electromagnetic rail gun.

Referring now to FIG. 1, there is illustrated a schematic representation of an electromagnetic rail gun 5, having two parallel, conductive rails 7, 7'. The conductive rails 7, 7' have two ends, a breech end 9 and a muzzle end 11. A projectile 31 will emerge from the muzzle end 11 after it is driven along the conductive rails 7, 7' by armature 20. Power supply 13 having input 15 connected to rail 7 generates an input current 17 in rail 7. This input current 17 moves along rail 7 until it contacts armature 20, becoming bridging armature current 21 and returns along rail 23 to terminal 25. A magnetic field 27 is generated between conductive rails 7, 7'. This magnetic field 27 in conjunction with the current causes a motive force in the direction of the muzzle end 11 of the electromagnetic rail gun 5. Projectile 31 is mounted within a sabot 29 which maintains the projectiles 31 position within and between the rails 7, 7'. The armature 20 is positioned contacting the sabot 29.

Figure 2:
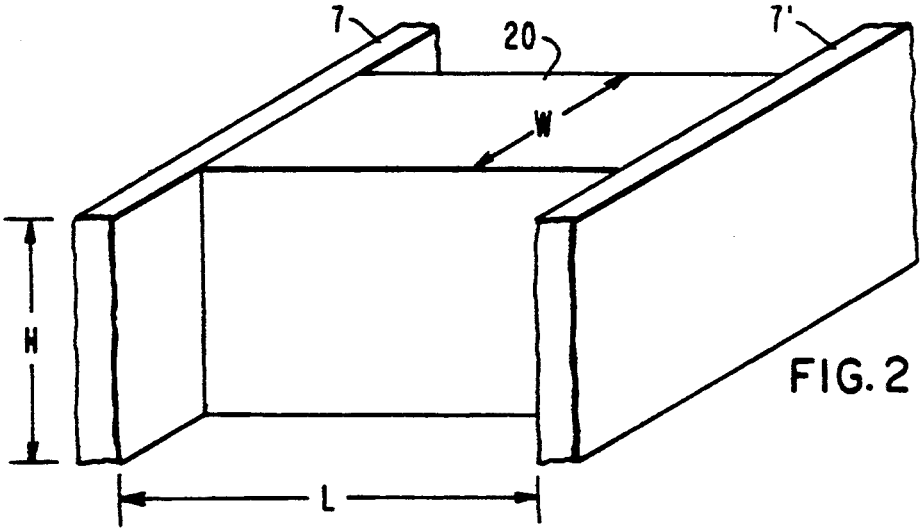
FIG. 2 is a schematic representation of an armature, as used in an electromagnetic rail gun.

FIG. 2 is a schematic representation of a simple rectangular armature 20, as used in an electromagnetic rail gun 5 as shown in more detail in FIG. 1. The solid block would be subdivided into lamina or wires to provide multiple independent contact points in order to reduce the sliding contact resistance. In terms of the parameters of length L, height H and width W as shown in FIG. 2, the armature 20 resistance is calculated by the expression:

$$R=\eta L/HW$$

where:

$\eta$ is the electrical resistivity.

If a bridging armature current 21, as more clearly shown in FIG. 1., flows in the armature 20 for a time period, t the energy dissipation is calculated by the expression:

$$\text{Energy}=I^2Rt.$$

If all of the energy, as calculated above goes to the raising of the temperature of the material in the armature 20, this change in temperature AT, is calculated by the expression:

$$mC_p\Delta T=I^2Rt.$$

where:

$C_p$ is the specific heat m is the armature mass.

By using the relationship:

$$m=\rho LHW$$

where:

$\rho$ is the density of the armature, all of these expressions can be combined to demonstrate that the mass, m of the armature required to absorb the generated thermal energy with a temperature rise equal to $\Delta T$ is:

$$m = IL\sqrt{\eta\rho t/C_p\Delta T}$$

For example, if the armature 20, as shown in FIG. 2. is made of copper and its initial temperature is 20° C., and its temperature increases to 212° C. to avoid excessive softening, the material parameters at this average temperature would be:

$$\eta=2.4\times10^{-8}\ ohm/m$$

$$\rho=8900\ Kg/m^3$$

$$C_p=400\ J/Kg-K$$

and, if:

$$I=10^{06}\ \text{Amp}$$

$$L=0.05\ \text{m}$$

$$t=0.01\ \text{sec.}$$

then a calculation of the temperature rise for an advanced rail gun system would require an armature 20 of the mass:

$$m=0.25\ \text{Kg}$$

Figure 3:
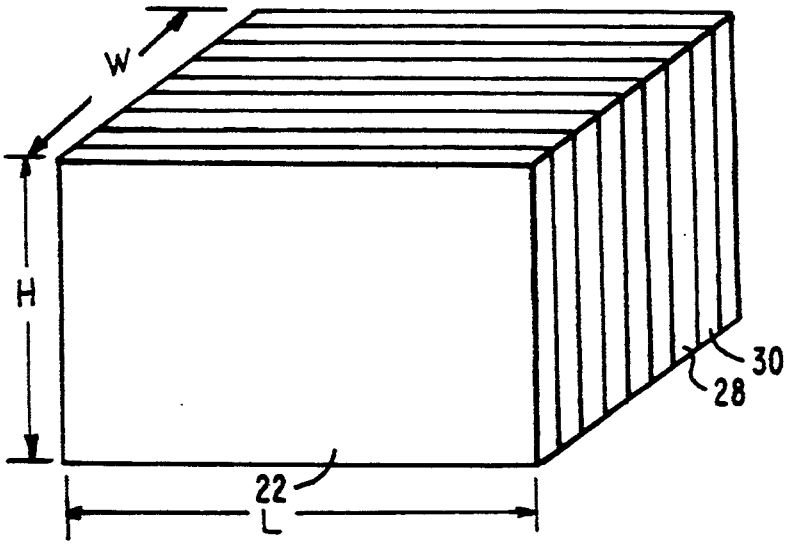
FIG. 3 is a schematic representation of one embodiment of the conducting phase change material (CPCM) armature.

FIG. 3 is a schematic representation of one embodiment of the conducting phase change material (CPCM) armature 22. This CPCM armature design must provide for intimate contact between the primary armature material 28 and the phase change material 30 to facilitate the heat transfer between them. One embodiment of this armature 20 is a layer of lamina of the primary armature material 28 with the CPCM 30 sandwiched between the layers as shown in FIG. 3. Bending the edges of the lamina 28, 30 achieves better sliding contact with the rails 7, 7' as clearly shown in FIG. 1.

Figure 4:
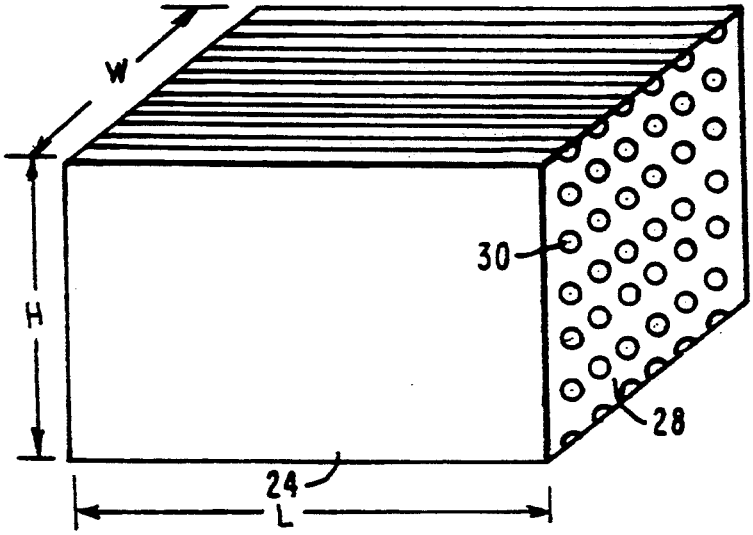
FIG. 4 is a schematic representation of another embodiment of the conducting phase change material (CPCM) armature.

FIG. 4 is a schematic representation of another embodiment of the conducting phase change material (CPCM) armature 24. In this embodiment wires of the conducting phase change material 30 run through the solid rectangular block of primary armature material 28.

The CPCM armature concept can be parameterized using the dimensions shown in FIGS. 3 and 4. The volume faction of primary armature material 28 in the lamina or wires is denoted as $\alpha_c$, where $0<\alpha_C<1$. The primary armature material 28, can be for example copper (Cu), although other materials having high conductivity would also suffice. The copper, for example, and the CPCM act as parallel conductors, in the embodiment of FIG. 3, the lamina, having an overall resistance as given by:

$$R=\left[\frac{1}{R_c}+\frac{1}{R_p}\right]^{-1}=\left[\frac{\alpha_C HW}{{}_cL}+\frac{(1-\alpha_C)HW}{\eta_p L}\right]^{-1}$$

The amount of CPCM in the armature is chosen so that the armature will rise just from 20° C. to the melt temperature of the CPCM and this rise in temperature plus the energy absorbed in the latent heat of the CPCM is sufficient to absorb all the resistance heating. If the rise in temperature is denoted as $\Delta T$, the mass, m of the CPCM, is calculated by:

$$m_p=\frac{I^2Rt-m_CC_{pc}\Delta T}{h_{sf}+C_{pp}\Delta T}$$

And, the mass of the copper in the armature is calculated by:

$$m_c=\rho_c\alpha_c\,\text{LWH}.$$

The total mass of the armature, $m_t$, is equal to the sum of $m_c$ and mp as given by these equations. It can be shown that $m_t$ is equal to $$m_t=\rho_c\alpha_c LWH\left[1-\frac{Ja}{\gamma Ja+1}\right]+\frac{I^2tL\eta_c}{HWh_{sf}(\gamma Ja+1)}[\alpha_c+(1-\alpha_c)\lambda]^{-1}$$

where:

$$Ja=C_{pc}\Delta T/h_{sf}$$

$$\gamma=C_{pp}/C_{pc}$$

$$\lambda=\eta_c/\eta_p$$

It is convenient to nondimensionalize mass by dividing through by the mass of a solid copper armature, $m_o$, which has the same length L, and is capable of sensibly absorbing the same energy with the same temperature rise, $\Delta T$. From an energy balance, $m_o$ must be given by $$m_o = IL\sqrt{\eta_c \rho_c t / C_{pc} \Delta T}$$

Dividing these equations defines $M = m_t/m_o$, yields:

$$M = \frac{\alpha_c}{\Gamma} \frac{W}{H}\left(1 - \frac{Ja}{\gamma Ja + 1}\right) + \frac{\Gamma(H/W)Ja}{(\gamma Ja + 1)[\alpha_c + (1 - \alpha_c)\lambda]}$$

where:

$$\Gamma = \sqrt{I^2 t \eta_c / H^4 \rho_c C_{pc} \Delta T}$$

Note that M is the ratio of the mass of the CPCM armature to the mass of a solid copper armature with the same cooling capability.

Given the above relation for M, when the geometry, material properties and operating conditions are specified, an optimum value of $\alpha_c$ sometimes exists which will minimize the mass of armature. Differentiating M with respect to $\alpha_c$ and setting it equal to zero, it can be shown that the value of $\alpha_c$ corresponding to a minimum M value is given by $$\alpha_{cm} = \left[\frac{H}{W}\sqrt{\frac{\Gamma^2 Ja(1-\lambda)}{1 + Ja(\gamma - 1)}} - \lambda\right](1 - \lambda)$$

Note that the value given by $\alpha_{cm}$ only makes sense if $0 < \alpha_{cm} < 1$.

For copper as the primary armature material and tin as the CPCM, the relevant properties are:

$\eta_c = 2.4 \times 10^{-8}\ \Omega m$, $\rho_c = 8900\ Kg/m^3$, $C_{pc} = 400\ J/Kg°K$.

$\eta_p = 11.0 \times 10^{-8}\ \Omega m$, $\rho_p = 7300\ Kg/m^3$, $C_{pp} = 220\ J/Kg°K$.

$h_{sf} = 5.9 \times 10^4\ J/Kg$

Using the same geometry and operating conditions as in the example in the introduction, with an appropriate value for H, $I = 10^6$ Amp; L=0.05 m; H=0.05 m; t=0.01 sec the nondimensional parameters defined above are $$\lambda = .204, \quad \gamma = .550$$
$$Ja = 1.144, \quad \Gamma = .223$$

With the above parameters specified, different W/H ratios can be considered, and the optimum value of $\alpha_c$, and the resulting value of M can be determined. For this example, the optimum $\alpha_c$ and the corresponding M values are plotted in FIG. 5. It can be seen the total mass of the CPCM armature can be as much as a factor of 2 lower than a solid copper armature with the same cooling capability (M=0.5) for a W/H ratio near 1.7 and a copper volume fraction near 5%. A 40% copper and 60% tin design with W/H=0.8 would reduce the mass by about 30%.

Figure 5:
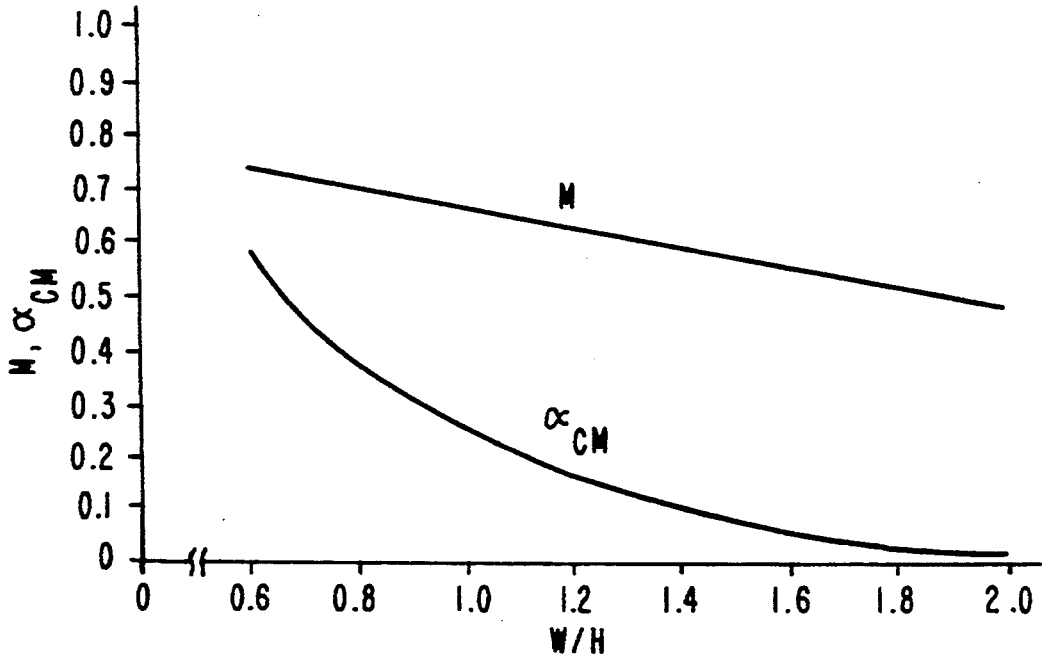
FIG. 5 is a graph of the optimum value of $\alpha_{CM}$, or volume fraction of primary armature material in the lamina or wires, where $0<\alpha_{cm}<1$, versus the ratio of armature width to height.

FIG. 5 is a graph of the optimum value of $\alpha_c$, or volume fraction of primary armature material in the lamina or wires, where $0 < \alpha_{cm} < 1$, and the resultant value of M, the mass of the armature versus W/H.

Numerous variations may be made in the above-described combination and different embodiments of this invention may be made without departing from the spirit thereof. Therefore, it is intended that all matter contained in the foregoing description and in the accompanying drawings shall be interpreted as illustrative and not in a limiting sense.

We claim:

1. An electromagnetic projectile launching system comprising:

at least two parallel conductive rails;

a power source connected to said conductive rails, said power source operable to supply a current to said rails;

a phase change material armature, said phase change material armature having lamina of electrically conducting phase change and primary conductive material, said phase change material armature cooperatively associated with said conductive rails, said electrically conducting phase change material armature including at least one layer of an electrically conductive phase change material, said electrically conductive phase change material operable to change from a solid state to a liquid state when exposed to an increase in temperature, said electrically conductive phase change material retaining its electrical conductivity in said solid and said liquid state;

at least two layers of an electrically conductive primary armature material, said electrically conductive primary armature material being cooperatively associated with said layer of electrically conductive phase change material to facilitate heat transfer;

said electrically conductive phase change material being a lamina layered between said layers of said electrically conductive primary armature material;

a projectile contacting said armature and operable to be moved along and between said rails when said armature contacts said rails and is supplied with said current.

2. Apparatus according to claim 1, wherein said electrically conductive phase change material is tin (Sn).

3. An electromagnetic projectile launching system comprising:

at least two parallel conductive rails;

a power source connected to said conductive rails, said power source operable to supply a current to said rails;

a phase change material armature, said phase change material armature having lamina of electrically conducting phase change and primary conductive material, said phase change material armature cooperatively associated with said conductive rails, said electrically conducting phase change material armature including at least one layer of an electrically conductive phase change material, said electrically conductive phase change material operable to change from a solid state to a liquid state when exposed to an increase in temperature, said electrically conductive phase change material retaining its electrical conductivity in said solid and said liquid state;

at least one layer of an electrically conductive primary armature material, said electrically conductive primary armature material being cooperatively associated with said layer of electrically conductive phase change material to facilitate heat transfer;

said electrically conductive phase change material being a multiplicity of wires, said wires being contained within and running through said electrically conductive primary armature material;

a projectile contacting said armature and operable to be moved along and between said rails when said armature contacts said rails and is supplied with said current.

* * * * *